United States Patent [19]

Barr

[11] Patent Number: 4,531,546

[45] Date of Patent: Jul. 30, 1985

[54] CONTROL SPOOL VALVE

[75] Inventor: Michael E. Barr, Dubuque, Iowa

[73] Assignee: Deere & Company, Moline, Ill.

[21] Appl. No.: 698,266

[22] Filed: Feb. 5, 1985

Related U.S. Application Data

[63] Continuation of Ser. No. 486,758, Apr. 20, 1983, abandoned.

[51] Int. Cl.[3] ..... F15B 13/08

[52] U.S. Cl. ..... 137/625.69; 137/625.48; 137/625.68

[58] Field of Search ..... 137/625.69, 625.68, 137/312, 625.48

[56] References Cited

U.S. PATENT DOCUMENTS

| | | | |
|---|---|---|---|
| 3,370,613 | 2/1968 | Weaver | 137/625.69 |
| 3,563,272 | 2/1971 | Mercier | 137/625.69 |
| 3,742,982 | 7/1973 | Miller | 137/625.68 |
| 4,009,730 | 3/1977 | Starling | 137/625.69 |

*Primary Examiner*—Edward G. Favors

[57] ABSTRACT

A spool valve having a pressure inlet port, a work port and a tank port. A spool valve is responsible for selectively communicating the pressure inlet port to the work port and the work port to the tank port. The work port is located between the pressure inlet port and the tank port. The spool contains a passageway which receives fluid from the pressure inlet port and directs the fluid between the work port and the tank port to provide a pressurized fluid seal between the work port and the tank port.

2 Claims, 1 Drawing Figure

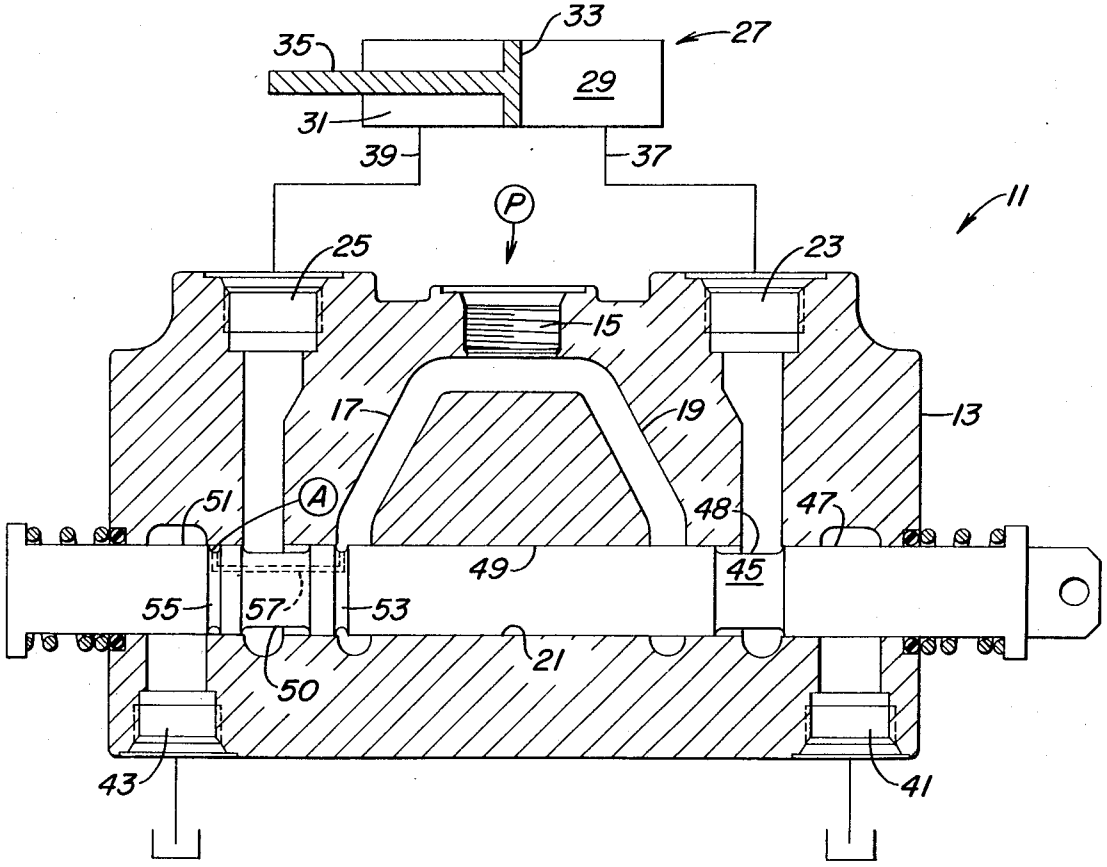
11
13
41
23
47
27
45
48
19
37
29
33
15
P
21
49
39
53
25
17
A
50
35
31
57
51
55
43

CONTROL SPOOL VALVE

This application is continuation of application Ser. No. 486,758, filed Apr. 20, 1983, abandoned.

BACKGROUND OF THE INVENTION

This invention relates to a control spool valve utilized in directing fluid to and from a work element.

A control spool valve is utilized in many applications to direct fluid to and from a work element. In some applications the excessive loads can be developed by the work element to cause excessive line pressure which results in valve spool seepage. When such seepage occurs, variations in the performance of the work element can result.

In one particular application of a control spool valve, the valve is used to control the positioning of a boom cylinder associated with an off-road vehicle such as excavators or backhoes. In this application, when the backhoe bucket is in a sustained raised position holding a load of rock, gravel, etc., within the bucket, the boom cylinder can experience an excessive down pressure which translates to the hydraulic fluid controlling the cylinder position. The corresponding spool position blocks flow within the valve. However, the excessive back pressure can cause seepage within the control valve along spool landings allowing the fluid seepage. Because of fluid seepage mainly from, the work port, the boom will experience a downed drift representing unstable and undesirable conditions.

SUMMARY OF THE INVENTION

A control spool valve having a pressure inlet port, a work port and a tank port whereupon fluid is conducted from the pressure port to the work port or from the work port to a tank port as a result of spool placement within the valve. In a steady state condition, i.e. no fluid flow within the valve, a passageway within the spool valve directs a small portion of the inlet pressure influenced fluid to a position within the control valve between the work port and the tank port to creat a pressure fluid seal therebetween. Therefore, in the steady state condition the fluid seal restricts flow between the work port and the tank port.

It is an object of the present invention to present a spool valve which inhibits seepage between the work port and tank port of the valve.

BRIEF DESCRIPTION OF THE DRAWING

The FIGURE respresents a schematic presentation of a control spool valve in fluid communication with the work element in compliance with the present invention.

DESCRIPTION OF THE PREFERRED EMBODIMENT

Referring to the FIGURE, a control spool valve, generally indicated as 11, is comprised of a housing 13 having a pressure inlet port 15 intersecting to a first channel inlet port 17 and a second channel inlet port 19. The housing 13 defines a elongated cylindrical chamber 21 intersecting to the inlet ports 17 and 19. A first work port 23 is contained within the valve housing 13 and intersects cylindrical chamber 21. A second work port 25 is also formed within the valve housing 13 intersecting cylindrical chamber 21. The pressure port 15 inclusive of inlet ports 17 and 19 are located between the first work port 23 and the second work port 25.

A hydraulic cylinder 27 has a first and second chamber 29 and 31 respectively, formed by the placement of a piston 33. The piston 33 includes a piston rod 35 which extends through the second cylinder chamber 31. The chambers 29 and 31 communicate with work ports 23 and 25, respectively, of control valve 11 through respective lines 37 and 39. The spool valve 11 further contains a first tank port 41 located outwardly of the first work port 23 and a second tank port 43 located outwardly of the second work port 25. The tank ports 41 and 43 intersects chamber 21.

A spool valve 45 is comprised sequentially of a first landing 47, a first recess 48, a second landing 49, a second recess 50 and a third landing 51 as viewed from right to left in the FIGURE. A first annular recess 53 is formed around a portion of the second landing 49 of the spool valve 45. A second annular recess 55 is formed around a portion of the third landing 51 of the spool 45. The annular recesses 53 and 55 are in communication by a passageway 57 within the spool valve 45. The spool is slidably mounted longitudinally with the chamber 21.

In operation the spool valve 11 has two operative modes and a neutral mode. The neutral mode, as shown in the FIGURE, positions the spool 45 such that fluid communication is blocked between any two ports. The first operative mode displaces the spool 45 from a neutral to the right allowing fluid communication between the first work port 23 and the first tank port 41 over the first recess 48. Further, the pressure inlet port channel 17 receives high pressure inlet fluid indicated as P. The fluid therefrom is delivered to the second work port 25 over the spool recess 50. In the first operative mode, pressure influenced is then delivered from work port 25 to cylinder chamber 31 through line 39 to fluidly pressurized chamber 31. Simultaneously, fluid is directed from the chamber 29 through line 37 to the work port 23 and therefrom to tank port 41 allowing the first cylinder chamber 29 to be placed in a dump mode.

As a result, the piston 33 is displaced to the right retracting cylinder rod 35. The neutral mode of operation of the control valve 11 is effectuated subsequent to the hydraulic cylinder 27 displacing to the desired position. The spool 45 is then displaced by any conventional means to obstruct fluid communication between any of the respective ports 41, 23, 19, 17, 25 and 43 of the control valve by landings 47, 49 and 51. In this mode, the annular recess 53 is aligned adjacent to the pressure inlet port 17, and the annular recess 55 is located between the second work port 25 and second tank port 43. The passageway 57 receives pressure influenced fluid from port 17 and conducts the fluid to a point, indicated as A, to deposit the fluid within annular recess 55 which in conjunction with the wall of cylinder 21 form a high pressure wet seal between work port 25 and tank port 43. Fluid within the work port 25 is inhibited from seeping into the tank port 43 in that the location of the wet seal at A is in close proximity to tank port 43 and provides a controlled fluid path for fluid within inlet port 17 through passageway 57. That is, the pressure within port 17 in the region of recess 53 is maintained at a level generally sufficient to restrain seepage from work port 25 to the tank port 43.

The third mode of operation would place the spool 45 to the left from the position shown in the FIGURE to allow communication in like manner to the first mode between the work port 25 over recess 50 and tank port 43 and communication between the work port 23 over recess 48 to the pressure inlet port 19. The second mode corresponds to an extraction of the piston 33 from the cylinder 27.

The aforedescribed invention has been directed particularly towards applications germaine to industrial vehicles where the cylinder 27 operates to control the boom of an excavator of backhoe. In such application, work port 25 when in communication with port 17 is responsible for raising the boom to a desired height. Once the desired boom height has been achieved, the present invention prevents fluid seepage from the cylinder 21 through line 39 and port 25 such that the boom will not experience a downward drift.

The aforedescribed preferred embodiment should not be viewed as limiting, the full scope of the present invention being defined by the appendix claim.

I claim:

1. In combination with a control valve having a housing defining an elongated cylindrical chamber, a pressure inlet port intersecting said chamber, a tank port intersecting said chamber and axially removed from said pressure inlet port, a work port intersecting said chamber and located axially between said pressure inlet port and said tank port, a valve spool slidably mounted axially within said chamber, said valve spool having a recess axially located between a first and second axial landing, said valve spool being slidably positionable such that in a first position fluid communication is derived from said pressure inlet port around said recess to said work port fluid communication to said tank port being blocked by said first landing, in a second position fluid communication from said work port to said inlet port is blocked by said second landing and to said tank port is blocked by said first landing and in a third position fluid communication is derived between said work port and said tank port around said recess and communication to said inlet port is blocked by said second landing, wherein the improvement comprises:

sealing means for providing a high pressure wet seal between said work port and said tank port when said valve spool is in said second position.

2. In a combination as claimed in claim 1, wherein said sealing means comprises a first annular recess around a portion of said second landing, a second annular recess around a portion of said second landing, a passageway within said valve spool providing a means of fluid communication between said first annular recess to said second annular recess, said annular recess so located such that when said valve spool is in said second position said first annular recess is axially located between said tank port and said work port and said second annular recess is located adjacent to said pressure input port whereby fluid from said inlet port is received in said passageway and delivered thereby to said first annular to be substantially confined therein by said chamber's well allowing controlled seepage to said work port and said tank port therefrom.

* * * * *